United States Patent [19]

Hillinger

[11] 4,440,205

[45] Apr. 3, 1984

[54] WEDGE AND AXE HEAD

[75] Inventor: George Hillinger, Los Angeles, Calif.

[73] Assignee: Alltrade, Inc., City of Commerce, Calif.

[21] Appl. No.: 355,869

[22] Filed: Mar. 8, 1982

Related U.S. Application Data

[63] Continuation-in-part of Ser. No. 176,530, Aug. 8, 1980, abandoned.

[51] Int. Cl.[3] ..... B26B 23/00

[52] U.S. Cl. ..... 145/2 R; 144/193 D; 254/104

[58] Field of Search ..... 145/2 R; 144/193 C, 144/193 D, 193 E, 193 F; 254/104

[56] References Cited

U.S. PATENT DOCUMENTS

| | | | |
|---|---|---|---|
| 443,581 | 12/1890 | Marshall | 144/193 D |
| 561,000 | 5/1896 | Karns | 145/2 R |
| 3,865,163 | 2/1975 | Root | 145/2 R |
| 4,044,808 | 8/1977 | Kolonia | 145/2 R |
| 4,383,562 | 5/1983 | Hockman | 145/2 R |

FOREIGN PATENT DOCUMENTS

| | | | |
|---|---|---|---|
| 443758 | 3/1975 | U.S.S.R. | 144/193 D |

*Primary Examiner*—Frederick R. Schmidt
*Assistant Examiner*—J. T. Zatarga

[57] ABSTRACT

An axe or wedge has a head with a cutting surface along an edge thereof. A pair of levers are pivotally mounted in transverse apertures formed in the head so as to pivot in opposite directions about a common axis aligned with the cutting edge. Stop means are provided in the transverse apertures so as to offset the levers to opposite sides of the head. Springs connected between the head and the levers normally hold the levers against the stops. The head has a recess formed above each lever and into which the lever may pivot so as to be flush with the head. In one embodiment, the levers are bifurcated and have camming surfaces which extend out of the head to the side opposite the offset and which, upon contact with wood being split, urge the levers from the stops into contact with the wood being split. The bifurcated arms are configured so as to provide a greater initial splitting force than is otherwise available, which force remains at a relatively constant factor over a substantial portion of the lever rotation.

7 Claims, 20 Drawing Figures

Fig. 6
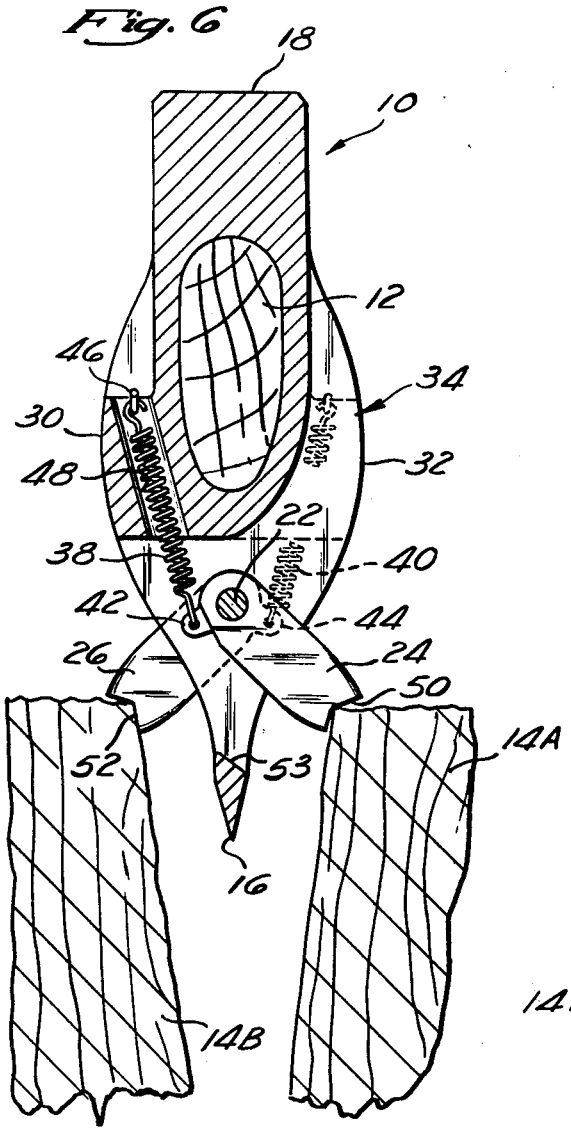
Fig. 7
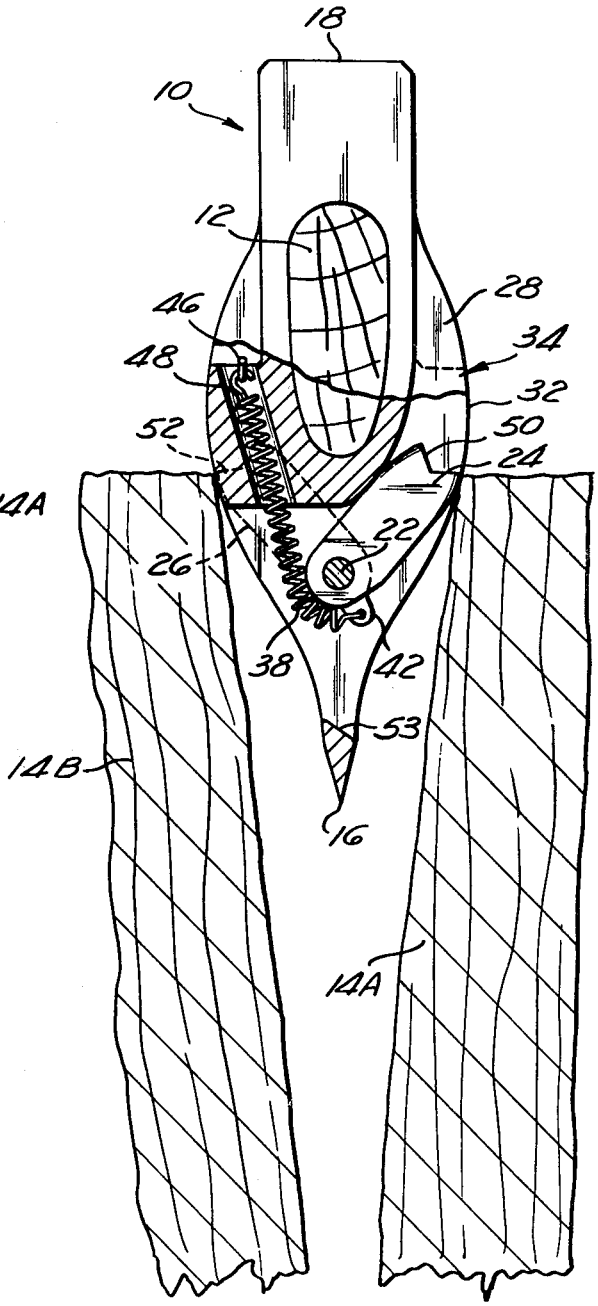
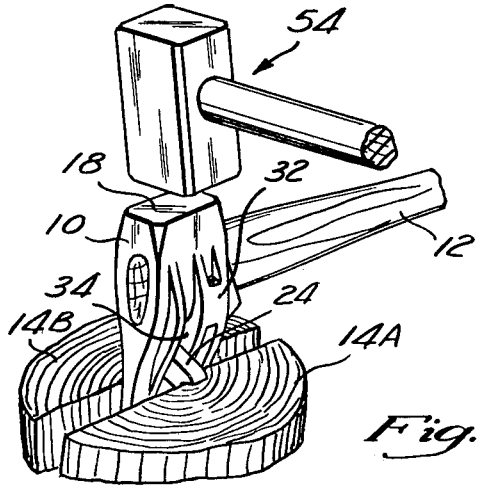
Fig. 8

WEDGE AND AXE HEAD

CROSS-REFERENCE TO RELATED APPLICATION

This application is a continuation in part of U.S. patent application Ser. No. 176,530, filed Aug. 8, 1980, now abandoned.

BACKGROUND OF THE INVENTION

This invention relates to an axe or wedge for splitting wood.

Devices are well known for use in splitting wood, such as logs. An example of a wedge type device particularly adapted for such use is shown in U.S. Pat. No. 3,865,163, issued Feb. 11, 1975 to Charles M. Root. In the device shown in this patent, a wedge is attached to a piston rod or the like, to which a pair of lever arms are also attached. The piston rod forces the wedge into the log to be split and, upon the wedge passing into the log in a conventional way, the lever arms engage the opening in the log and force the log apart. This device uses a toggle principle for the lever arms, and the splitting force exerted by the arms is at a minimum upon the arms engaging the wood at the commencement of splitting. The splitting force gradually increases as the arms rotate toward the horizontal. However, the maximum splitting force is desirable on the initiation of splitting, rather than at completion.

An example of an axe type device for use in splitting logs is shown in U.S. Pat. No. 4,044,808, issued Aug. 30, 1977 to Robert A. Kolonia. In this device, a conventional axe head is modified by the addition of a pair of crossed lever arms which are pivotally offset with respect to each other and the central axis of the head. The lever arms are crossed so as to extend through the head transversely, each being pivoted on one side of the head and protruding from the opposite side. The axe is utilized in conventional fashion. The lever arms engage the log to be split, at the commencement of splitting, and, as the axe head enters the split, the lever arms pivot outwardly to provide an increasing splitting pressure on the log. Thus, again in the type construction, which eventually provides a greater splitting action for a given downward force, results in an increasing splitting force being applied as the levers rotate toward the horizontal. As the levers approach horizontal, little downward energy is applied by the axe head, and it may become stuck in the split. Also, in such an axe head, the lever arms become locked in an outward protruding position in the log, and so provide considerable resistance to downward pressure, if the log has not already split. Because in the locked position the lever arms are substantially normal to the direction at thrust of the axe head, a greatly increased downward thrust is necessary to accomplish further downward movement of the axe head through the wood, often, this problem requires the stuck axe head being struck with a sledge to provide further splitting. Further, because the pivot points for the lever arms are offset from the center of the head, a blow by the axe which is either not quite vertical or which strikes a knot or other discontinuity in the log, causes the axe head to lose its balance and to be diverted from its downward path with a resultant uneven splitting of the log, or even create a very dangerous side trajectory of the axe. As in U.S. Pat. No. 3,865,163, the minimum splitting force exists as the levers initially contact the wood, and the relatively flat surfaces existing at the point of impact when splitting is initially attempted result in an abrupt energy transfer from the axe to the log, often causing the axe to rebound from the wood, if hard wood or a large diameter log is attempted to be split.

SUMMARY OF THE INVENTION

According to the present invention, an axe or wedge has a head portion with a cutting surface conventionally formed thereon along the longitudinal plane of symmetry. Adjacent the cutting surface there are disposed a pair of levers, which are utilized to spread the log being split. The levers are pivoted about a common axis which falls on the longitudinal plane of symmetry of the head, in parallel with the cutting edge. The levers are mounted in recesses formed in the head so that the log engaging ends are offset, one to each side of the head. The levers are spring loaded so as to be normally urged against stops formed in the head adjacent to the cutting edge. The levers pivot against the spring loading away from the stops upon engagement of the levers with the log or other object being split. The head has a recess formed on each side above the respective lever, which receives the lever upon upward pivoting of the lever away from the cutting edge during the splitting operation so that, at the upward extremity of the pivoting of the levers, the levers are substantially flush with the head.

The movement of the levers away from the stops can be initiated by either of two different lever configurations. In a first configuration, movement is initiated in conventional fashion by having the lever end initially contact the log at the surface of the split and be rotated outwardly as the head progresses into the split, as is shown in the aforesaid U.S. Pat. No. 4,044,808. In a second, presently preferred configuration, the lever is bifurcated into a splitting arm and a log engaging rotation arm and has a camming surface formed on the splitting arm so as to extend out from the head. This camming surface initi ates contact between the lever and the log at the split, forcing the lever out into the split so as to widen the split. After the lever camming surfaces force rotation of the levers away from the stops by contact with wood in the split, the lever rotation arm contacts the wood beyond the split, rotating the levers upwardly and the splitting arms outwardly. By utilizing the log rotation arm, a relatively constant splitting force is provided which exceeds the splitting force initially provided by the aforementioned prior act devices for comparable downward thrusts on the head, whether initiated by swinging the axe or striking the wedge with a sledge or otherwise driving the cutting edge of the head into the wood or other object to be split.

BRIEF DESCRIPTION OF THE DRAWINGS

The present invention can be more readily understood by referring to the accompanying drawings, in which:

FIG. 6 is a view similar to FIG. 5, but showing a further splitting of the log;

FIG. 7 is a view similar to FIGS. 5 and 6, but showing a further splitting of the log and in which the combined axe head and wedge is in a disposition suitable for use as a wedge;

FIG. 8 is an isometric view illustrating the use of the combined axe head and wedge as a wedge in the disposition shown in FIG. 6;

DETAILED DESCRIPTION

Figures 1, 2, 3, 4, 5:
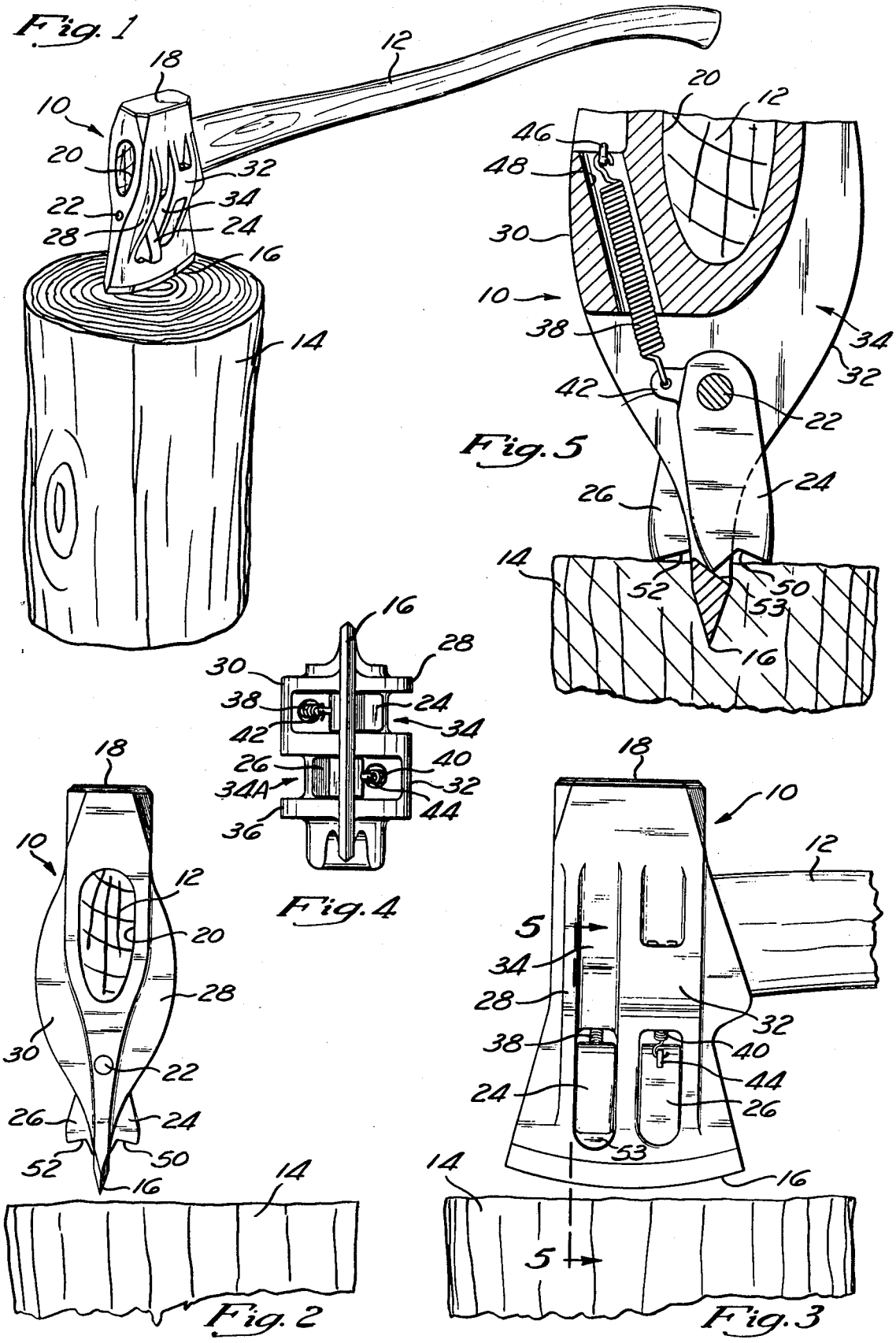
FIG. 1 is an isometric view of a combined axe head and wedge according to a first embodiment the present invention, including the axe handle and log to be split.
FIG. 2 is an end view of the combined axe head and wedge shown in FIG. 1.
FIG. 3 is a left side elevational view of the combined axe head and wedge shown in FIG. 1.
FIG. 4 is a bottom elevational view of the combined axe head and wedge of the present invention, but with the handle removed.
FIG. 5 is a view taken along lines 4—4 of FIG. 3 generally, but modified so as to show the initial splitting of the log.

Referring now to FIG. 1, there is shown a combined axe and wedge head 10 which is attached, in conventional fashion, to an axe handle 12 and is disposed immediately above a log 14. The head 10 has a cutting edge 16 which is similar to that on a conventional axe and an impact receiving surface 18 opposite the cutting surface 16, the impact receiving surface 18 being similar to that on a conventional wedge. An aperture 20 formed in the head 10 receives the axe handle 12. As will be apparent hereinafter, the aperture 20 has an axis with which the cutting surface 16 and impact surface are aligned, and which lies in the longitudinal plane of symmetry of the head 10, as does the cutting edge 16.

Referring now to FIG. 2, there is shown an end elevational view of the head 10. A pivot pin 22 extends through the head 10 and has a first lever 24 and a second lever 26 mounted thereon so as to pivot from a common axis which is aligned with the cutting surface 16, impact surface 18 and axis of the aperture 20. The levers 24, 26 pivot in opposite directions. In FIG. 2, it is seen that the head 10 has a first rib 28 and a second rib 30 which shield, in part, the respective levers 24, 26. The ribs 28, 30 also provide an additional width to the head in order to assist in the splitting action and to provide recesses into which the levers 24, 26 can rotate upwardly so as to be substantially flush with the head 10.

Referring now to FIG. 3, there is shown a left side elevational view of the head 10, illustrating the relative side by side disposition of the first and second levers 24, 26. In FIG. 3, it is seen that a third rib 32 is formed on the head 10 and separated from the first rib 28 by the first lever 24 and a first lever receiving recess 34. The third rib 32 is much wider than the first rib 28 by reason of the the recess 34.

As is shown in FIG. 4, a complementary structure consisting of the second rib 30 and a fourth rib 36 forms a second lever receiving recess 34A on the opposite side of the head 10. In FIG. 5, each of the levers 24, 26 is seen to have a bias spring 38, 40, respectively, attached at one end thereof by attaching lugs 42, 44, respectively. The spring 38 is connected, at its other end, to the head by means of an ear 46 which is formed at the end of a passageway 48, through which the spring 38 extends. The spring 40 is similarly attached on the opposite side of the head 10. The levers 24, 26 have ends 50, 52, respectively, which engage stops 53 formed in the head 10 adjacent the cutting surface 16 so as to constitute the lower ends of the recesses 34, 34A.

Figure 19:
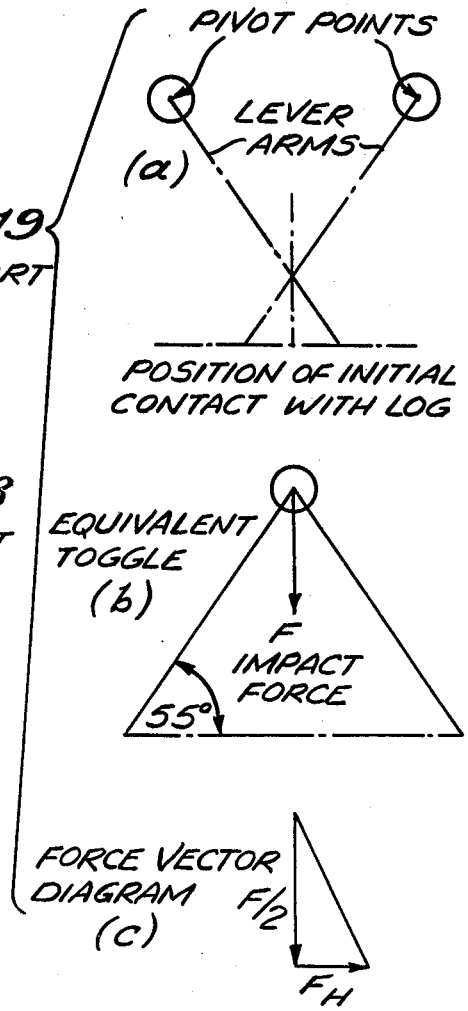
Fig. 19 PRIOR ART
FIG. 19, parts a, b, and c taken together, is a depiction and splitting force vector diagram for another prior art embodiment.

In FIG. 5, it will be noted that the cutting edge 16 has entered into the log 14 to the extent that the levers 24, 26, at their log engaging ends 50, 52, remote from the pivot 22, have initially contacted the log 14 at its upper surface. As will be seen, the lever ends 50, 52 form a substantially flat transverse surface opposing entry into the log 14. The splitting moment exerted by the lever when so disposed is quite small because the lateral splitting force vector of the levers is very small compared to the downward force vector. See FIG. 19.

Referring now to FIG. 6, it is seen that the head cutting surface 16 has entered further into the log 14 and that the cutting surface 16 no longer engages the log 14, the log being split partially into two sections 14A, 14B which are held away from the cutting edge by the levers 24, 26. In FIG. 6, the splitting action on the log 14 is derived from the outward pressure of the levers 24, 26 on the log sections 14A, 14B, rather than the head 10 proper.

FIG. 7 shows a further penetration of the cutting surface 16 into the log 14. This penatration may have been achieved either by a use of the head 10 as an axe, that is, striking a blow onto the log, or by utilizing the head 10, when in a disposition such as is shown in FIG. 8, as a wedge. In either event, as is seen in FIG. 7, the levers 24, 26 have pivoted upwardly in the lever receiving recesses 34, 34A so that the levers 24, 26 are flush with the outer surfaces of the rib portions of the head 10. Thus, any further penetration of the head 10 into the log 14 with the help of a sledge, without first withdrawing the head 10 from the log 14, will not be impeded by the levers 24, 26 engaging the sides of the split portions 14A, 14B of the log 14 and becoming lodged therein.

Referring now to FIG. 8, there is shown the head 10 in the general configuration shown in FIG. 6, but with the addition of a sledge hammer 54. As is shown in FIG. 8, the sledge hammer 54 is utilized to pound upon the impact receiving surface 18 of the head 10, thereby driving the head 10 into the log 14 so as to widen the split formed therein until the log ultimately splits into two pieces. Thus, the head 10, in this utilization, functions as a wedge. Obviously, if desired, the head, if to be used only as a wedge, may have the handle aperture 20 eliminated. As will be noted, after rotation of the levers 24, 26 into the recesses 34, 34A, the head presents a smooth contour to the log 14, thereby enabling the head to function much as an ordinary axe or wedge, without the locked, laterally protruding levers and lever mounting surface of U.S. Pat. No. 4,044,808.

While the terms "cutting surface" and "cutting edge" have been used, it is obvious that the degree of sharpness of such an edge is relative, and dependent upon the particular usage to which the head is to be put. Thus a wedge normally will have a chisel or blunt edge, while an axe will have a keener edge. Thus, the term "cutting surface" and "cutting edge" are intended to be exemplary, and not terms of limitation, as the invention is not dependent thereon.

Figure 9:
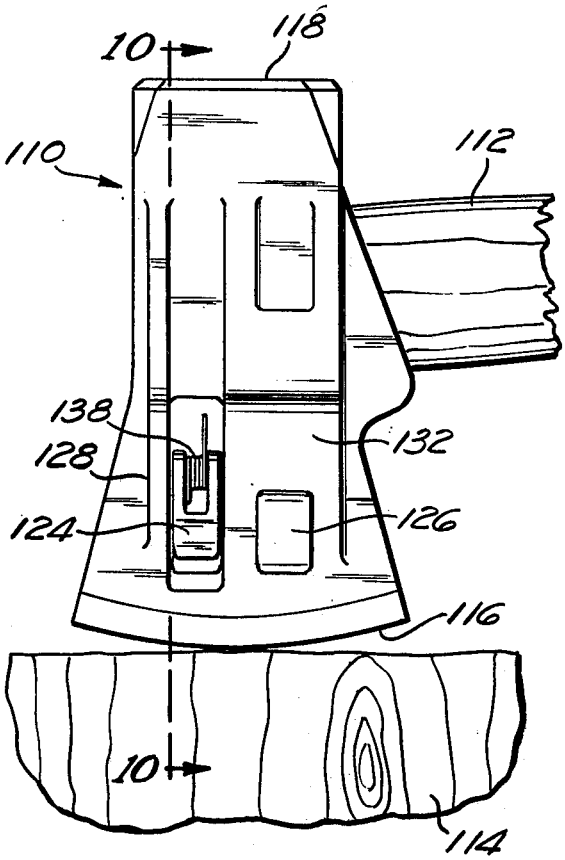
FIG. 9 is a side elevational view of a modified axe or wedge head according to the present invention.

Referring now to FIG. 9, there is shown a left side elevational view of a modified combined axe and wedge head 110 which is attached, in conventional fashion, to an axe handle 112 and is disposed immediately above a log 114. The head 110 has a cutting edge 116 which is similar to that on a conventional axe and an impact receiving surface 118 opposite the cutting surface 116, the impact receiving surface 118 being similar to that on a conventional wedge. An aperture 120 formed in the head 110 receives the axe handle 112. As will be apparent hereinafter, the aperture 120 has an axis with which the cutting surface 16 and impact surface are aligned, and which lies in the longitudinal plane of symmetry 121 of the head 110, as does the cutting edge 116.

Figure 10:
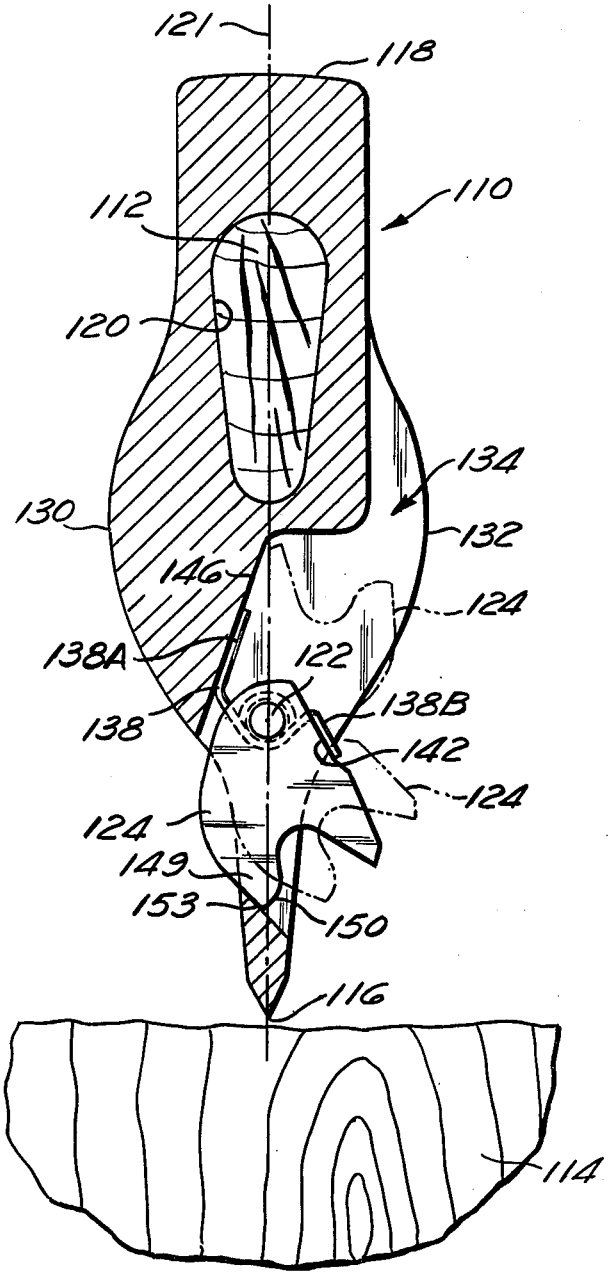
FIG. 10 is a view taken along lines 10—10 of FIG. 9.

Referring now to FIG. 10, there is shown an end elevational view of the head 110, taken along lines 10—10 of FIG. 9. A pivot pin 122 extends through the head 110 and has a first lever 124 and a second lever 126 mounted thereon so as to pivot from a common axis which is aligned with the cutting surface 116, impact surface 118 and axis of the aperture 120 so as to be in the longitudinal plane of symmetry 121 of the head 110. As shown in FIGS. 9 and 10, the levers 124, 126 pivot in opposite directions. The head 110 has a first rib 128 and a second rib 130 which shield, in part, the respective levers 124, 126. The ribs 128, 130 also provide an additional width to the head in order to assist in the splitting action and to provide recesses into which the levers 124, 126 can rotate upwardly so as to be substantially flush with the head 110. A third rib 132 is formed on the head 110 and separated from the first rib 128 by the first lever 124 and a first lever receiving recess 134. The third rib 132 is much wider then the first rib 128 by reason of the the recess 134.

A complementary structure consisting of the second rib 130 and a fourth rib (not shown, see FIG. 4) forms a second lever receiving recess (not shown, see FIG. 4) on the opposite side of the head 110 from the first lever receiving recess 134. The lever 124, has a torsional bias spring 138, which encloses the pivot 122 and has a first arm 138A which engages a face 146 on the head 110 and a second arm 138B which engages a face 143 on the lever 124. The lever 126 is similarly attached on the opposite side of the head 110. The lever 124 is bifurcated, having a lever splitting arm 149 with a face 150 for contacting the wood within the split. The arm 149 engages a stop 153 formed in the head 110 adjacent the cutting surface 116 so as to constitute the lower end of the recess 134 and, as will be described hereinafter, assists in splitting the wood 114.

Figure 11:
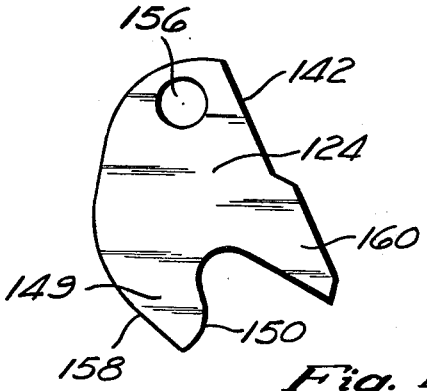
FIG. 11 is an elevational view of a log splitting lever for use in the embodiment of FIG. 9.

In FIG. 11, the lever 124 is shown in a side elevation view. The lever 126 is the mirror image of lever 124. The lever 124 has a pivot aperture 156 formed opposite the splitting arm face 150 and a camming surface 158 formed at the edge of the lever therebetween which functions to initiate lever rotation, as will be explained hereinafter. On the opposite side of the lever 124, a lever rotation arm 160 is formed which is engaged by the upper surface of the wood 114 after lever rotation has commenced, and rotates the lever 124 during the latter part of splitting operation, as well be described hereinafter.

Figure 12:
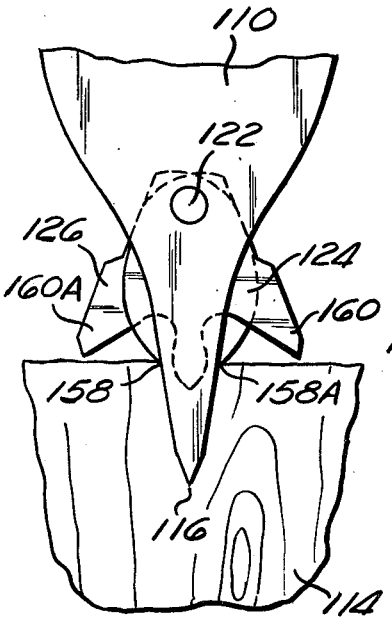
FIG. 12 is a partial front elevation of the modified head of FIG. 9 initially penetrating a log to be split after the commencement of lever rotation.

In FIG. 12, the cutting edge 116 is shown as having entered into the log 114 to the extent that camming surface 158 of lever 124, and a complementary camming surface 158A on the lever 126 have initially contacted the log 114 at the split on its upper surface. However, the splitting arm face 150 (see FIG. 13) and a complementary splitting arm face 150A formed on a lever splitting arm 149A on the lever 126 (see FIG. 15) remain within the head 110, not opposing entry of the head 110 into the log 114. The splitting force exerted by the head 110 when so disposed is that of a conventional head because no lateral splitting force from the lever splitting arm faces 150, 150A exists because the faces 150, 150A do not contact the log 114.

Figure 13:
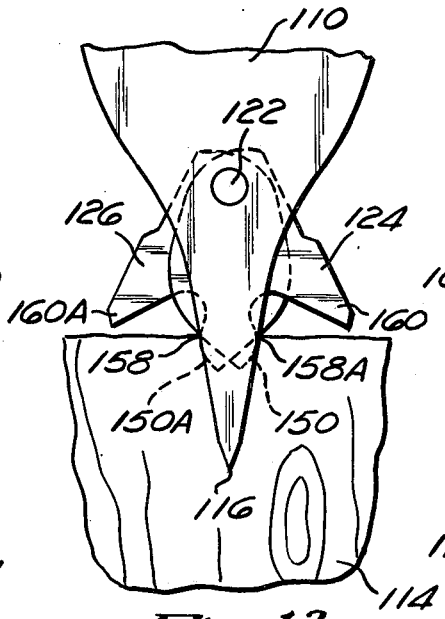
FIG. 13 is a partial front elevation of the modified head, illustrating further lever rotation.

Referring now to FIG. 13, it is seen that the head cutting surface 116 has entered further into the log 114. In FIG. 13, the splitting action on the log 114 is derived both from the head 110 and from the outward pressure of the splitting arm faces 150, 150A on the log 114. The camming sections 158, 158A have engaged the log 114 at the split, forcing the splitting arm faces 150, 150A outward into the split and against the wood within the split.

Figure 14:
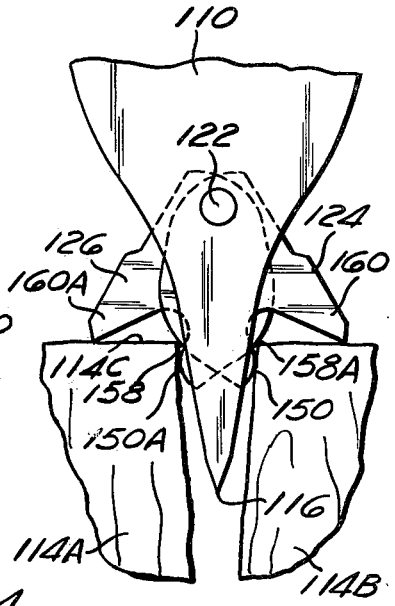
FIG. 14 is a partial front elevation of the modified head, illustrating still further lever rotation.

FIG. 14 shows a further penetration of the cutting surface 116 into the log 114. This penetration may have been achieved either by a use of the head 110 as an axe, that is, striking a blow onto the log, or by striking a sledge on a similarly configured head without the aperture 120, i.e.; a wedge. In FIG. 14, the splitting arm faces 150, 150A contact the split in the wood 114 to the extent that the wood 114 has widened beyond the width of the cutting edge 116. The camming surfaces 158, 158A continue to engage the two sides 114, 114A of the log, rotating their respective splitting arm faces 150, 150A outwardly against the opposite sides of the log portions 114A, 114B. The lever rotation arm 160, and a complementary lever rotation arm 160A on the lever 126, have just contacted the log 114 of its upper surface 114C. Further downward movement of the head 110 will cause additional rotation of the levers 124, 126 by reason of the contact between the lever rotation arms 160, 160A and the wood surface 114C, resulting in further outward rotational movement of the splitting arm faces 150, 150A when the camming surfaces 158, 158A no longer directly engage the log 114 within the split.

Figure 15:
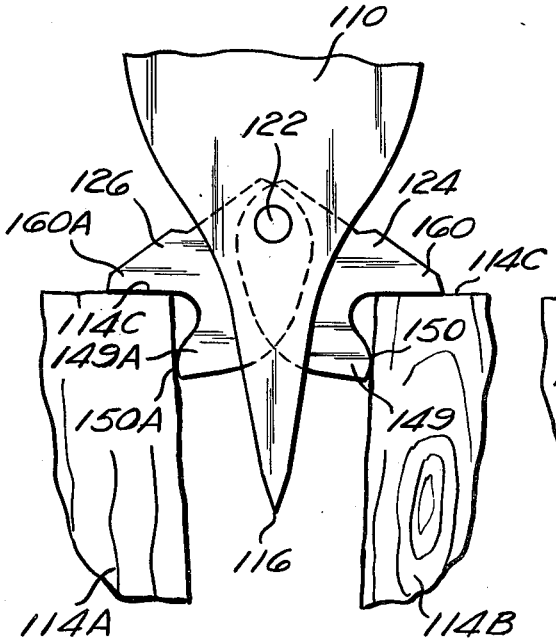
FIG. 15 is a partial front elevation of the modified head, illustrating lever rotation in addition to that shown in FIG. 14.

In FIG. 15, the head 110 has progressed further into the split. The camming surfaces 158, 158A no longer contact the split, and lever rotation is accomplished by the rotation of the lever rotation arms 160, 160A in contact with the top surface 114C of the log 114A, 114B.

Figure 16:
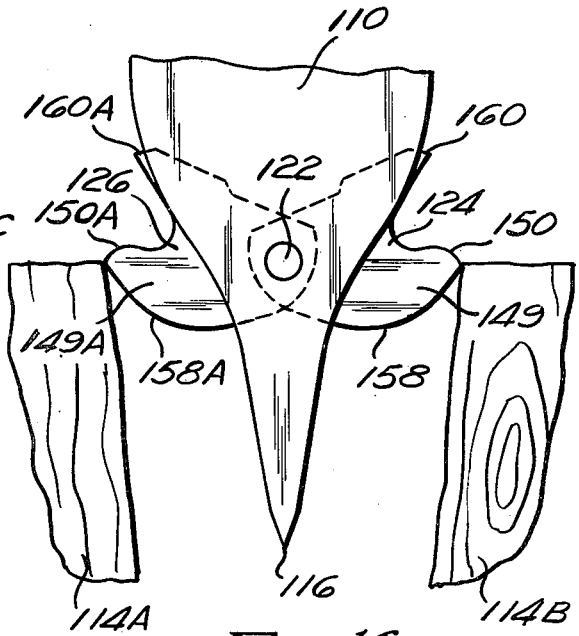
FIG. 16 is a partial front elevation of the modified head, illustrating still further rotation of the lever.

In FIG. 16, the head 110 has progressed still further into the split. The lever rotation arms 160, 160A no longer contact the log 114, and the tips of the splitting arms 149, 149A are at their outermost extremity. Further downward movement of the head causes the levers 124, 126 to rotate upwardly into the lever receiving recesses such as 134 for lever 124 (see FIG. 10). This upper rotational position of the lever 124 and the intermediate rotational position of FIG. 13 are shown in dotted lines in FIG. 10. Such additional downward movement of the head 110 from the position shown in FIG. 16 returns the head to a conventional splitting function for that downstroke, as the levers 124, 126 do not contribute substantially to splitting thereafter.

Figure 17A:
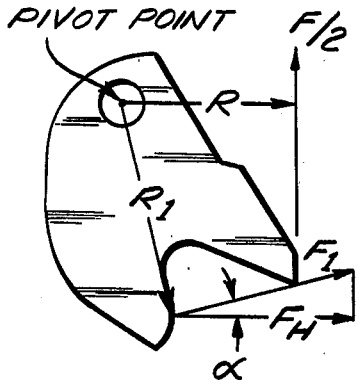
FIG. 17, parts a and b taken together, illustrate the splitting force vector diagrams for two lever rotational positions, corresponding to FIGS. 14 and 15, respectively.

Referring now to FIG. 17*a*, there is shown the lever 124 with the force vector diagram illustrating the splitting force which the lever develops when in the position shown in FIG. 14, i.e., after the initial contact of the splitting arm face 150 with the log 114. Dimension R represents the distance to the point of wood contact on the lever rotation arm 160 from the center of the pivot, measured normal to the force vector F/2, which represents the upward force on the rotating arm produced by contact of the rotating arm tip with the top of the log, and, so, is directly proportional to the downward force of the head 110. Dimension $R_1$ represents the distance from the center of the pivot to the point of contact of the splitting arm face 150 with the log 114 within the split. The vector $F_1$ represents the splitting force vector normal to dimension $R_1$, and vector $F_H$ represents the splitting vector normal to the direction of movement of the head 110. It can be shown that $(F/2)(R)=F_1R_1$. The angle alpha is the angle of attack, i.e., the angle between $F_1$ and $F_H$. Therefore, $F_H=F_1$ cosine alpha$=(F/2)(R/R_1)$ cosine alpha. The splitting arm face 150 has a pre-selected contour to provide initial contact of the splitting arm 149 and the log 114 to give a desired ratio of $R/R_1$. In the embodiment of FIGS. 10–16, this ratio is 0.8. The angle of attack alpha is small, approximately 14 degrees, so that cosine alpha$=0.97$. $F_H$ then equals 0.39F, or the splitting force vector normal to the direction of the head movement is about four-tenths of the downward force.

Figure 17B:
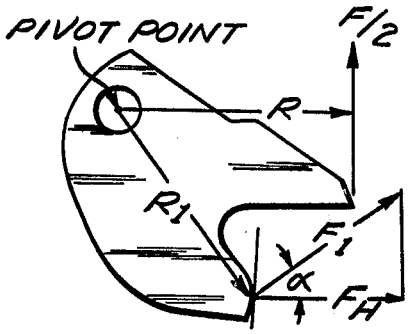

As the lever 126 rotates to the position shown in FIG. 15, to which FIG. 17*b* corresponds, the dimension $R_1$ approaches the dimension R, so that $R/R_1=1$. The angle of attack alpha, however, has increased to about 35 degrees, so that cosine alpha now is 0.82. In the disposition shown in FIG. 17*b*, $F_H$ therefore equals 0.41F, or the splitting force equals about four-tenths of the downward force.

After the splitting face 150 has contacted the wood as shown in FIG. 13, and prior to the lever rotation arms 160 contacting the wood as is shown in FIG. 14, the rotation of the splitting arms 149, 149A produces a slight splitting effect, which can be shown to be approximately 0.2F. However, the splitting arms 149, 149A are primarily functioning as a wedge during this movement, slightly widening the effective splitting width of the head 110 over the width of the fixed components alone adjacent the cutting edge 116.

Further rotation of the rotation arms 160, 160A beyond the position shown in FIGS. 15 and 17*b* toward the position shown in FIG. 16 results in a substantial loss in splitting force, due to the shortening of the dimension R resulting from contact of the log splitting face 114C with the rotation arm 160 inboard of the tip of the arm 160 at which contact was initiated (see FIG. 14). If desired, the inboard portion of the rotation arms 160, 160A can be recessed so as to delay the rotation at which such contact occurs. Thus, the splitting moment of the modified head 110 of the present invention has remained substantially constant for a lever rotation from the initiation of lever rotation arm contact to the lever rotation arm disposition at which the splitting moment begins to diminish.

Figure 18:
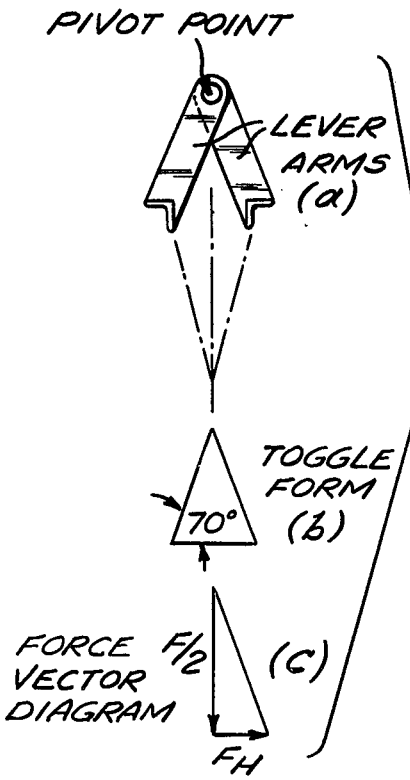
Fig. 18 PRIOR ART
FIG. 18, parts a, b, and c taken together, is a depiction and splitting force vector diagram for one prior art embodiment.

The principal splitting effect of the levers 124, 126 commences when the rotation arms 160, 160A initially contact the wood. After the rotation arms 160, 160A have rotated away from contact with wood, as is shown in FIG. 16, the levers 149, 149A revert, in their operation, to that of the prior art Root type toggle shown in FIG. 18, providing a splitting force $F_H$ which is a function of the tangent of the toggle angle, and hence larger than the splitting force provided by the rotation arm moments. However, unlike the Kolonia device, the levers 124, 126 are free to rotate into the head, rather than be locked in a horizontal position as in the Kolonia patent.

Such performance is to be contrasted with the teachings of the prior art. For example, the prior art Root U.S. Pat. No. 3,865,163 has a pair of lever arms illustrated in FIG. 18*a*. FIG. 18*b* shows the equivalent toggle form for the Root lever arms. FIG. 18*c* shows the force vector diagram for the Root lever arms at commencement of splitting. The splitting force vector $F_H$ is relatively small as compared to the downward force vector F/2, due to the large toggle angle of 70 degrees, whose tangent function provides a splitting force moment, i.e., $F_H=F/2$ tan Beta, where Beta is the toggle angle. As this toggle angle decreases by spreading of the lever arms, the splitting force will increase, so that the split becomes wider, an increasing amount of the downward head force is converted to splitting force. However, if the log does not readily split, the loss of downward force to splitting force may cause the jamming of the head in the split, requiring the lever arms to bear the entire load for splitting. Unless the lever arms are very strongly constructed, they may fail in such service.

The prior art Root patent provided a very small splitting force initially, whereas it is desirable to have a much larger initial splitting force, particularly in a manually swung device. In order to provide a larger initial splitting force, the prior art Kolonia U.S. Pat. No. 4,044,808 moved the pivot points outboard from the longitudinal plane of symmetry of the head to initially produce a much smaller toggle angle. FIG. 19*a* illustrates the alignment of the Kolonia lever arms with the longitudinal plane of symmetry. FIG. 19*b* shows the equivalent toggle diagram for the Kolonia device. It will be seen that the toggle angle has been reduced to about 55 degrees, providing splitting force, which is a tangent function of the angle (see FIG. 19*c*) of about 0.35F, as computed from the formula $F_H=F/2$ tan Beta, where Beta is the toggle angle.

From the foregoing, it will be evident that the present invention avoids the shortcomings of the prior art. For example, unlike the Kolonia device, the levers according to the present invention may pivot upwardly into recesses formed in the head so as to flush therewith. During the initial stages of splitting, the splitting force is relatively constant, rather than constantly increasing. A greater initial splitting force is achieved. As the Kolonia device is simply an equivalent toggle when compared to the Root device, improved so as to achieve a higher initial splitting force, the present invention is similarly advantages with respect thereto.

The invention claimed is:

1. In a device having a head with a longitudinal cutting surface formed on one edge of said head so as to lie on the longitudinal plane of symmetry of the head, the combination of:

a longitudinal pivot aperture formed in said head and disposed so as to lie in the longitudinal plane of symmetry;

lever aperture means formed in the body between the pivot aperture and the cutting surface so as to extend transversely across the head and intersect the pivot aperture;

a first lever disposed in the lever aperture means and pivotally mounted to the head by means of the pivot aperture so as to extend towards the cutting surface;

first lever stop means formed in the lever aperture means and operable to engage the first lever to prevent the pivotal movement of the first lever through the lever aperture means, whereby the first lever is laterally offset at its end adjacent the cutting surface to a first side of the head;

a second lever disposed in the lever aperture means and pivotally mounted to the head by means of the pivot aperture so as to extend toward the cutting surface;

second lever stop means formed in the lever aperture means and operable to engage the second lever to prevent the pivotal movement of the second lever through the lever aperture means, whereby the second lever is laterally offset at its end adjacent the cutting surface to a second side of the head opposite said first side;

spring means for normally holding said first and second lever remote ends against the first and second lever stop means.

2. Apparatus according to claim 1, and including recesses formed in the head above the levers said recesses being adapted to receive the respective lever when said lever pivots against the spring means, whereby said lever may pivot upwardly into said recess to a position in which said lever is substantially flush with the adjacent head portion.

3. Apparatus according to claim 1, and in which the lever aperture is comprised of a first aperture and a second aperture, said apertures being disposed in a side by side relationship with one of said levers extending through each thereof.

4. Apparatus according to claim 1, 2 or 3, and in which the levers are bifurcated and each includes a splitting arm on one side thereof and a lever rotation arm opposite the splitting arm, said rotation arm being separated from the splitting arm by a recess adapted to receive the upper surface of the object being split and, when so received, to rotate the lever against the biasing of the spring means in response to relative movement between the head and the object.

5. Apparatus according to claim 4 and in which the splitting arm has a camming surface formed thereon so as to be remote from the lever rotation arm and normally extend out of the lever aperture means so as to initiate contact of the lever with object being split.

6. Apparatus according to claim 4, and in which the levers are bifurcated with a splitting arm and a lever rotating arm, and in which the splitting arm has a splitting face formed of one end thereof facing the rotation arm, and in which the ratio (R cos alpha)/$R_1$ is approximately constant over a substantial portion of lever rotation, where R is the length of the rotation arm from the pivot to the point of contact with an object being split;

$R_1$ is the length of the splitting arm from the pivot to the point on the splitting face in contact with the object being split; and alpha is the angle of attack of the splitting face.

7. Apparatus according to claim 6, and in which the splitting arm has a camming surface formed thereon so as to be remote from the splitting face and normally extend out of the lever aperture means so as to initiate contact of the lever with the object being split.

* * * * *